US007250926B2

(12) United States Patent
Suzuki et al.

(10) Patent No.: US 7,250,926 B2
(45) Date of Patent: Jul. 31, 2007

(54) METHOD OF DRIVING FLAT DISPLAY APPARATUS AND DRIVING SYSTEM

(75) Inventors: Koji Suzuki, Yokohama (JP); Keiko Albessard, Yokohama (JP); Masahiko Yamamoto, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 440 days.

(21) Appl. No.: 10/705,966

(22) Filed: Nov. 13, 2003

(65) Prior Publication Data

US 2004/0145544 A1 Jul. 29, 2004

(30) Foreign Application Priority Data

Nov. 14, 2002 (JP) ..... 2002-331052

(51) Int. Cl.
*G09G 3/20* (2006.01)

(52) U.S. Cl. ..... 345/74; 345/204; 345/205; 345/206

(58) Field of Classification Search ..... 345/74, 345/204, 205, 206
See application file for complete search history.

(56) References Cited

U.S. PATENT DOCUMENTS 5,394,067 A * 2/1995 Santelmann, Jr. ..... 315/411

FOREIGN PATENT DOCUMENTS

| | | |
|---|---|---|
| JP | 11-282412 | 10/1999 |
| JP | 11-282413 | 10/1999 |
| JP | 2000-098968 | * 4/2000 |
| JP | 2000-98968 | 4/2000 |

OTHER PUBLICATIONS

E. Yamaguchi, et al., *Journal of the SID*, vol. 5, pp. 345-346 and 348, "A 10-In. Surface-Conduction Electron-Emitter Display", 1997.

* cited by examiner

*Primary Examiner*—Richard Hjerpe
*Assistant Examiner*—Leonid Shapiro
(74) *Attorney, Agent, or Firm*—Oblon, Spivak, McClelland, Maier & Neustadt, P.C.

(57) ABSTRACT

In a method of driving a display apparatus, a first combination of a first anode voltage and a first element voltage is selected to apply the first anode voltage to the anode electrode and apply the first element voltages to electron emitting elements selectively, during a first period. The first combination is changed to a second combination of a second anode voltage and a second element voltage after the first period to apply the second anode voltage to the anode electrode and apply the second element voltages to the electron emitting elements selectively, during a second period. After the second period, the second combination is also change to the first combination.

38 Claims, 6 Drawing Sheets

METHOD OF DRIVING FLAT DISPLAY APPARATUS AND DRIVING SYSTEM

CROSS-REFERENCE TO RELATED APPLICATIONS

This application is based upon and claims the benefit of priority from the prior Japanese Patent Application No. 2002-331052, filed Nov. 14, 2002, the entire contents of which are incorporated herein by reference.

BACKGROUND OF THE INVENTION

1. Field of the Invention

The present invention relates to a method of driving a display apparatus having a phosphor layer which is excited by an electron beam generated from a flat electron source and, more particularly, to a display apparatus driving method for a display panel having a phosphor layer excited by an electron beam which is generated due to a field emission of electrons, the method substantially reducing a concentration of electrons on a particular point of the phosphor layer to prevent the phosphor layer from being decreased in the luminous efficacy.

2. Description of the Related Art

As a display panel having a phosphor layer excited by an electron beam, a cathode ray tube, a so-called Braun tube, is available as a well-known apparatus. The Braun tube has a high response speed and wide viewing angle characteristics, and is an emission type display apparatus. For these reasons, this apparatus has been widely used as a high-quality imaging apparatus for a TV set. However, as the screen size of the Braun tube increases, its weight and depth dimension increase. It has therefore been considered that 40-inch size is the limit, and 30-inch size is the limit for home use. On the other hand, the TV system is undergoing a shift from the NTSC system to the high-definition system. With an improvement in the quality of video signals, demands have arisen for low-profile, lightweight, and large-screen display apparatuses.

As a low-profile display apparatus capable of providing high-quality pictures on a large screen, a plasma display panel (PDP) has been commercialized. The PDP can realize a large-screen panel at low cost, because interconnection lines and pixels can be formed by a printing technique. In the PDP, electrical discharges are generated in respective pixels, and ultraviolet rays are generated in the pixels. The ultraviolet rays excite phosphor layers, and light rays are emitted from the phosphor layers to display an image. The PDP displays pictures based on a principle of displaying pictures similar to that for the Braun tube. The PDP, however, is considered to have the following problems. (1) Since a phosphor of the PDP is excited to emit light on the basis of irradiation of ultraviolet light, the luminous efficacy of a phosphor material is low, and the power consumption is high. (2) In the PDP, since the discharge time is very short, in order to obtain a desired luminance, discharge must be repeated for the same pixel. In order to realize a high luminance, emission must be repeated during each field period. A plurality of number of times of this discharge may result in an unnatural movement of a moving picture. (3) In the PDP, the discharge voltage is as high as about 200 V, and hence a high breakdown voltage driver IC is required. As a consequence, the cost of a driver IC tends to be relatively high.

As a large-screen, low-profile display which has currently received attention, a flat display apparatus having a phosphor layer to be excited by an electron beam using a flat electron source is available. The basic structure, manufacturing method, and driving method of this flat display apparatus are disclosed in E. Yamaguchi et al., "A 10-in. SCE-emitter display", Journal of SID, Vol. 5, p. 345, 1997.1. As reported by E. Yamaguchi et al., the flat display apparatus has the following characteristics. (1) An element array for emitting electrons can be formed by printing. (2) The apparatus uses substantially the same emission principle as that for a Braun tube having a phosphor layer excited by electrons to emit light. (3) In addition, a flat electron source can be driven by a voltage of ten-odd V, and hence allows the use of a low-breakdown-voltage driver IC.

As disclosed by E. Yamaguchi et al., in a phosphor display apparatus using flat electron sources, a matrix of flat electron sources is formed on a glass substrate serving as a rear plate. Each flat electron source is constituted by a pair of element electrodes arranged adjacent to each other and an element film formed between the element electrodes and on the element electrodes. The flat electron source is driven by a voltage applied between the pair of element electrodes to emit electrons from an electron emitting portion formed in the element film. A glass substrate called a faceplate is placed to oppose the rear plate, and the faceplate is coated with phosphor layers, which emit red (R), green (G), and blue (B) light beams for each pixel. Anode electrodes made of aluminum are formed on the phosphor layers. A vacuum is held between the two plates. Electrons emitted from each flat electron source are accelerated by an anode voltage and strike the phosphor layer. The phosphor is excited by the energy of the accelerated electrons to emit light. The emission principle of this flat display apparatus is the same as that of a Braun tube. In the Braun tube, an electron beam emitted from an electron gun is deflected by a deflection coil to scan the screen with the electron beam. In contrast to this, in the phosphor display apparatus using the flat electron sources, electrons are emitted from the flat electron source provided for each pixel, and the phosphor layer corresponding to each pixel is excited to emit light. In addition, the phosphor display apparatus greatly differs from the Braun tube in that the rear and faceplates are held at a distance of about sever mm so as to be a low-profile display apparatus.

As has been described above, this electron source includes a pair of opposing element electrodes, an element film, and an electron emitting portion formed in the element film. A given drive voltage Vf is applied to the pair of element electrodes to emit electrons from the electron emitting portion. A flat display apparatus using such electron sources is characterized in that a voltage that starts electron emission is as low as about 10 V, and a voltage that is used to obtain an electron emission amount required for the phosphor to emit light with a sufficient luminance is as low as ten-odd V. In the flat display apparatus, an emitted electron is influenced by a force acting from the low-potential side of an element electrode to the high-potential side, and the emitted electron is displaced and travels to the anode electrode. As a consequence, the electron forms a curved locus having a given directionality. This produces a deviation between the irradiation position of the electron on the faceplate and the position of the electron emitting portion of the electron source.

A display apparatus having a phosphor layer excited by an electron beam emitted from such a flat electron source uses phosphor excitation/emission by an electron beam with high luminous efficacy, and hence consumes only a small amount of power even with a large screen. In addition, when a phosphor emits light, a raster emits light for a selected very short period of time. Since this display is not of a hold type as in a liquid crystal display apparatus (LCD) and PDP, natural pictures can be displayed even in moving picture display operation. In addition, the screen luminance of this apparatus has no viewing angle dependence as in an LCD, and hence the apparatus has wide viewing angle characteristics. Furthermore, since a flat electron source can be operated at ten-odd V, it can be driven by a low-voltage driver IC.

As described above, electrons emitted from the electron emitting portion of each electron source are injected into the anode electrode. When such an electron is emitted, a directionality is given to the electron such that it is attracted to one of the pair of element electrodes which is on the high-potential side. The emitted electron therefore has not only an initial velocity component directed to the anode electrode but also an initial velocity component displaced toward the electrode on the high-potential side. As a consequence, the emitted electron forms a curved locus and travels toward the anode electrode to reach the anode electrode at a position displaced from a position on the anode electrode which is immediately above the electron emitting portion and opposes it.

The actual emission pattern generated by this emitted electron has an emission peak at a position deviated from the geometric center of the pattern, and has a distribution in which the luminance is monotonously attenuated from the emission peak as the center. For this reason, at a position where an emission peak appears, the anode current density is always high. Even with the same operation time, therefore, a large quantity of electrons are injected into a portion of the phosphor layer which corresponds to this position. It is generally known that the emission luminance of a phosphor decreases in accordance with the amount of electric charge injected. For this reason, at a position where the anode current density is high, the luminous efficacy abruptly decreases, resulting in a decrease in the luminance of pixels. Although a region where this emission peak appears is small in area, the region corresponds to a region in which a large amount of electric charge is injected. In addition, the ratio of this region which contributes to overall emission luminance is higher than the area of the region which contributes to the overall emission luminance. For this reason, a further decrease in luminance occurs in accordance with the emission intensity, and the overall luminance decreases quickly.

BRIEF SUMMARY OF THE INVENTION

It is an object of the present invention to provide a driving method which makes an improvement in terms of a decrease in luminance due to current concentration and to provide a driving method which can prolong the service life of a display apparatus having a phosphor layer which is excited by an electron beam.

According to an aspect of the present invention, there is provided a method of driving a display apparatus, the display apparatus including:

a first substrate having a first surface;

electron emitting elements, each configured to emit an electron beam, which are arranged on the first surface of the first substrate in a matrix form;

a second substrate having a second surface which faces the first surface with a gap therebetween;

an anode electrode formed at the second surface, and a phosphor layer formed on the anode electrode, and configured to emit light rays in response to irradiation of the electron beam;

the display method comprising:

selecting a first combination of a first anode voltage and a first element voltage;

applying the first anode voltage to the anode electrode during a first period and applying the first element voltage to the electron emitting elements selectively during the first period;

changing the first combination to a second combination of a second anode voltage and a second element voltage;

applying the second anode voltage to the anode electrode during a second period and applying the second element voltage to the electron emitting elements selectively during the second period; and changing the second combination to the first combination after the second period.

According to an another aspect of the present invention, there is provided a system for driving a display apparatus, comprising:

a first substrate having a first surface;

electron emitting elements, each configured to emit an electron beam, which are arranged on the first surface of the first substrate in a matrix form;

a second substrate having a second surface which faces the first surface with a gap therebetween;

an anode electrode formed at the second surface, and a phosphor layer formed on the anode electrode and configured to emit light rays in response to irradiation of the electron beam;

a selecting portion configured to select a first combination of a first anode voltage and a first element voltage to apply the first anode voltage to the anode electrode and apply the first element voltage to the electron emitting elements selectively, during a first period; and a changing portion configured to change the first combination to a second combination of a second anode voltage and a second element voltage after the first period to apply the second anode voltage to the anode electrode and apply the second element voltage to the electron emitting elements selectively, during a second period, and change the second combination to the first combination after the second period.

DETAILED DESCRIPTION OF THE INVENTION

A method of driving a flat display apparatus having a phosphor layer to be excited by electron beams according to the present invention will be described below with reference to the several views of the accompanying drawing.

Figure 1:
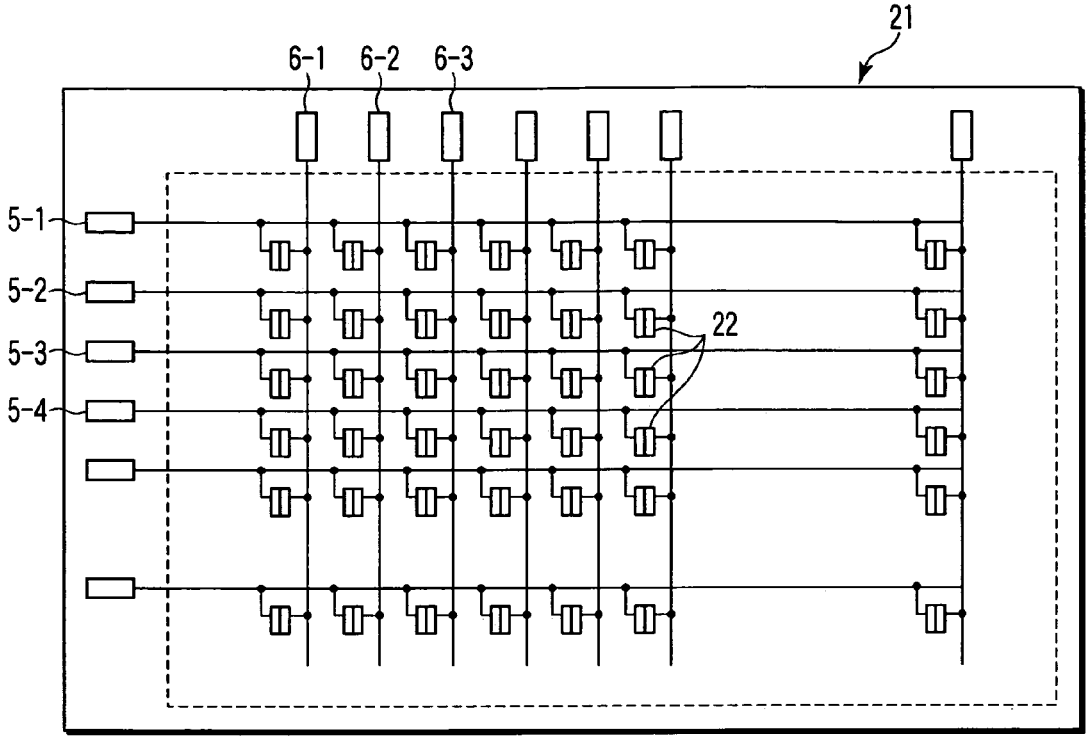
FIG. 1 is a plan view schematically showing the structure of a display apparatus which has a phosphor layer which is excited by an electron beam and to which a method of driving a flat display apparatus according to the present invention is applied.

FIG. 1 is a plan view schematically showing the structure of a flat display apparatus using electron sources to which a driving method of the present invention is applied.

A flat display apparatus using electron sources, i.e., a flat display panel, has a rear plate 21 having a structure shown in FIG. 1. The rear plate 21 has a matrix of electron sources 22 formed a glass substrate 11 . In addition, a plurality of scanning lines 5-1, 5-2, . . . are arranged parallel to each other, and a plurality of modulation lines 6-1, 6-2, . . . are arranged parallel to each other in a direction perpendicular to or crossing the scanning lines 5-1, 5-2, . . . . The scanning lines 5-1, 5-2, . . . and the modulation lines 6-1, 6-2, . . . are insulated from each other by an insulating material (not shown). The flat electron sources 22 are arranged in pixel regions corresponding to the intersections of these lines. Element electrodes 13 and 14 of each electron source 22 are arranged to oppose each other and are respectively connected to a corresponding one of the scanning lines 5-1, 5-2, . . . and a corresponding one of the modulation lines 6-1, 6-2, . . . . Voltages are applied between the element electrodes of the electron sources 22 through the scanning lines 5-1, 5-2, . . . and the modulation lines 6-1, 6-2, . . . to cause the electron sources 22 to emit electrons toward the anode.

Figure 2:
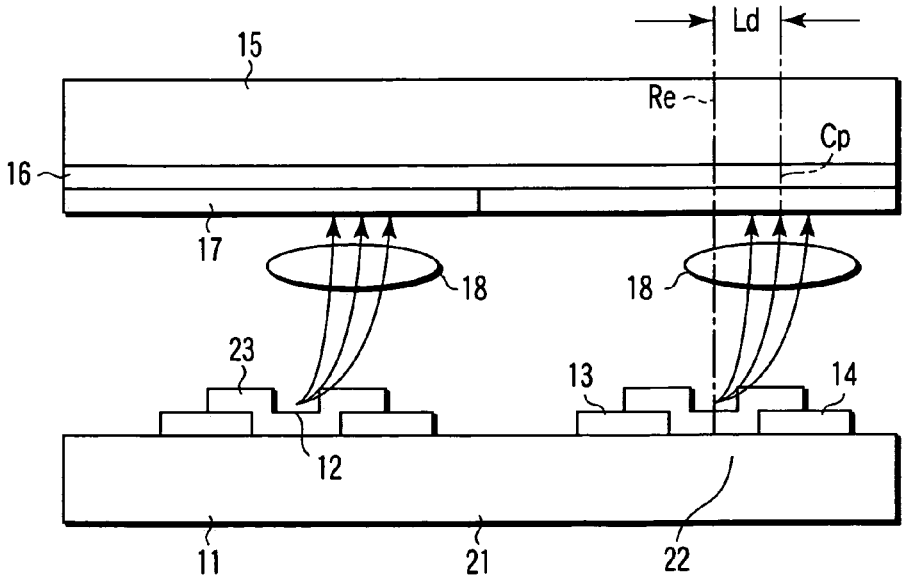
FIG. 2 is a sectional view schematically showing a sectional structure of the display apparatus having the phosphor layer shown in FIG. 1.
Figure 3:
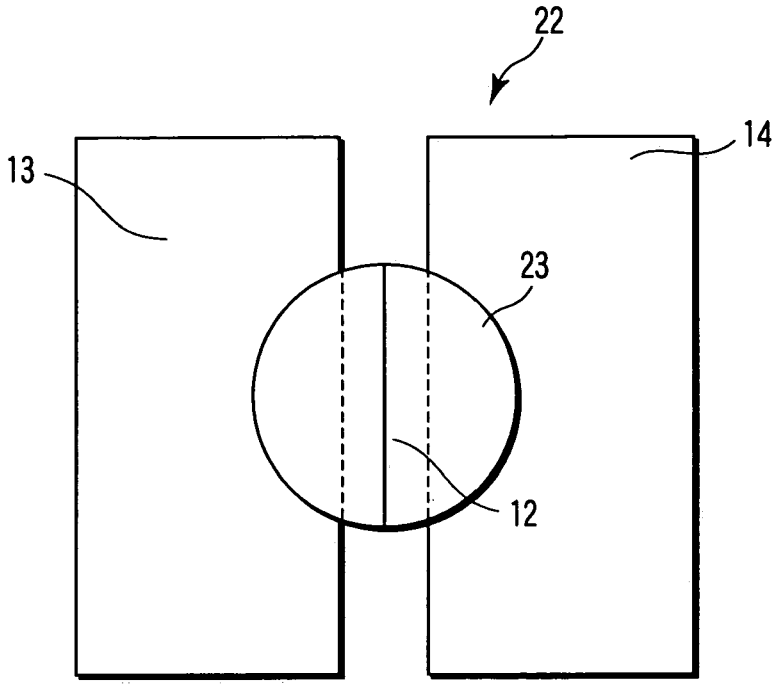
FIG. 3 is a plan view schematically showing the structure of an electron emitting portion of the display apparatus having the phosphor layer shown in FIGS. 1 and 2.

As shown in FIGS. 2 and 3, the electron source 22 is constituted by the pair of element electrodes 13 and 14 arranged close to each other on the glass substrate 11 , the glass substrate 11 between the element electrodes 13 and 14, and an element film 23 formed on the element electrodes 13 and 14. The electron source 22 is driven by a voltage applied to the pair of element electrodes 13 and 14 to emit electrons from an electron emitting portion 12 formed in the element film 23. A glass substrate called a faceplate 15 is arranged to oppose the rear plate 21. The faceplate 15 is coated with phosphor layers 16 for emitting red (R), green (G), and blue (B) light beams. An anode electrode 17 made of aluminum is formed on the phosphor layer 16. A vacuum is held between the two plates 21 and 15. An electron 18 emitted from the flat electron source is accelerated by an anode voltage to strike the phosphor layer 16 . The phosphor layer 16 is then excited by the energy of the electron 18 to emit light.

Figure 4:
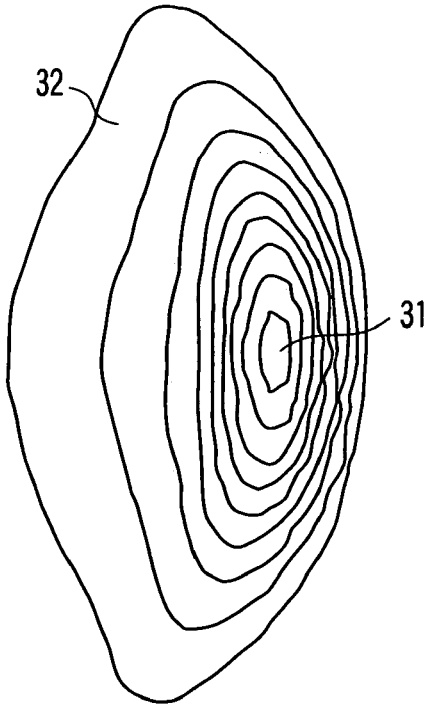
FIG. 4 is a view showing an emission pattern on the phosphor layer in the display apparatus having the phosphor layer shown in FIGS. 1 and 2.

In the flat display apparatus using the electron source 22, one of the pair of element electrodes 13 and 14 to which a voltage is applied is maintained at a low potential, and the other electrode is maintained at a high potential. The electron 18 emitted from the electron emitting portion 12 of the element film 23 is subjected to a force acting from the element electrode 13 on the low-potential side to the element electrode 14 on the high-potential side. The emitted electron 18 therefore travels from the electron emitting portion 12 to the anode electrode 17 while being so displaced as to separate from a reference line Re substantially perpendicular to the anode electrode 17. As a consequence, as shown in FIG. 2, the electron 18 forms a curved locus having a certain directionality, and a deviation Ld based on the displacement occurs between an intensity center Cp of a region on the faceplate 15 which is irradiated with the electron and the reference line Re passing through the electron emitting portion 12 on the electron source 22. Since an intensity center Lp is displaced in the irradiation region of the electron, an actual emission pattern 32 formed by the emitted electron 18 also has a peak 131 of the emission center at a position displaced from the geometric center of the pattern, and hence has a distribution in which the luminance is monotonously attenuated from the emission peak as the center, as shown in FIG. 4.

In the flat electron source array shown in FIGS. 1 to 3, all the electron source components, e.g., the element films 23, element electrodes 13 and 14, scanning lines 5-1, 5-2, . . . , and modulation lines 6-1, 6-2, . . . , can be formed by printing. Although not shown, the insulating layer provided between the scanning lines 5-1, 5-2, . . . and the modulation lines 6-1, 6-2, . . . to insulate them from each other can also be formed by printing.

A flat display apparatus including a phosphor which has a structure like the one described above and is excited by an electron beam is driven by driving methods according to various embodiments of the present invention which will be described below. In these driving methods, there are prepared at least two combinations of an anode voltage Va to be applied to the anode electrode 17 and an element voltage Vf to be applied to the element electrodes 13 and 14 to emit electrons from the electron emitting element 23 formed on the glass substrate 11, and the voltages in these combinations are switched at predetermined operation time intervals of the display panel.

The embodiments of the methods of driving the flat display apparatus having the phosphor which is excited by an electron beam according to the present invention will be described in more detail below.

FIRST EMBODIMENT

A method of driving a flat display apparatus having a phosphor which is excited by an electron beam according to the first embodiment of the present invention will be described with reference to FIGS. 5A to 9.

Figure 5A:
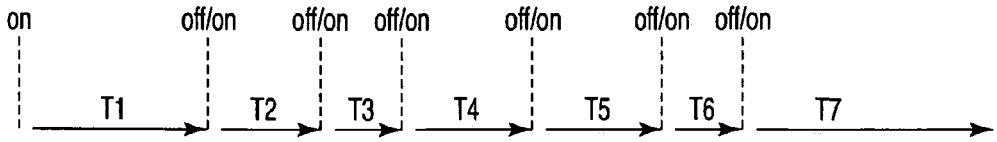
FIGS. 5A to 5E are views showing an operation sequence for driving the display apparatus having the phosphor layer shown in FIGS. 1 and 2 to which the method of driving the flat display apparatus according to an embodiment of the present invention is applied.

FIGS. 5A to 5E are views showing a sequence associated with the method of driving the flat display apparatus. In general, the flat display apparatus is not always maintained in the operation mode in which an image is displayed. Instead, the flat display apparatus is turned on by a user and maintained in the operation mode, and turned off by the user to be set in the non-operation mode. The operation mode and non-operation mode are repeated. More specifically, as shown in FIG. 5A, the flat display apparatus is turned on at a given point of time and displays an image in the operation mode for a given time interval T1. Thereafter, the flat display apparatus is turned off and maintained in the non-display state in the non-operation mode. The flat display apparatus is restored to the operation mode again to display image for a given time interval T2. Thereafter, the apparatus is turned off. This operation is repeated. Referring to FIG. 5A, time intervals T1 to T7 represent time intervals during which the flat display apparatus is turned on and maintained in the operation mode of displaying images.

Figure 5B:
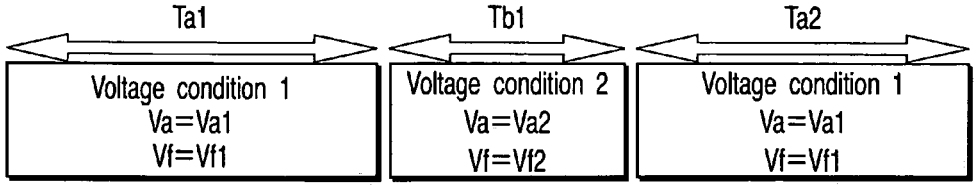
Figure 5C:
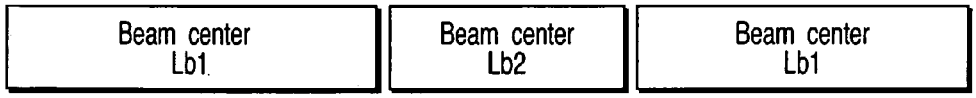
Figure 5D:
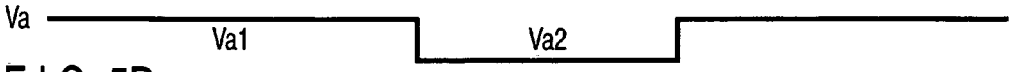
Figure 5E:
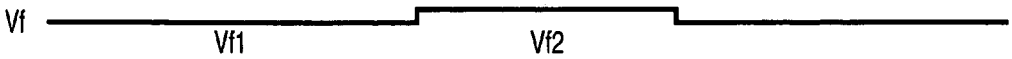

In the operation mode during the time interval T1, the flat display apparatus is operated in the first driving mode set in the first set condition (Va1, Vf1) as shown in FIG. 5B, in which an anode voltage. Va1 is applied to an anode electrode 17, and an element voltage Vf1 is applied to element electrodes 13 and 14 of an electron source 22, as shown in FIGS. 5D and 5E. At the lapse of the time interval T1, the power switch of the display apparatus is turned off to shift to the non-operation mode. Thereafter, the power switch of the display apparatus is turned on again. In the next time interval T2, therefore, the flat display apparatus is operated in the first driving mode to display images in the same manner as described above. Likewise, in the next time interval T3, the flat display apparatus is operated in the first driving mode to display images.

Figure 6:
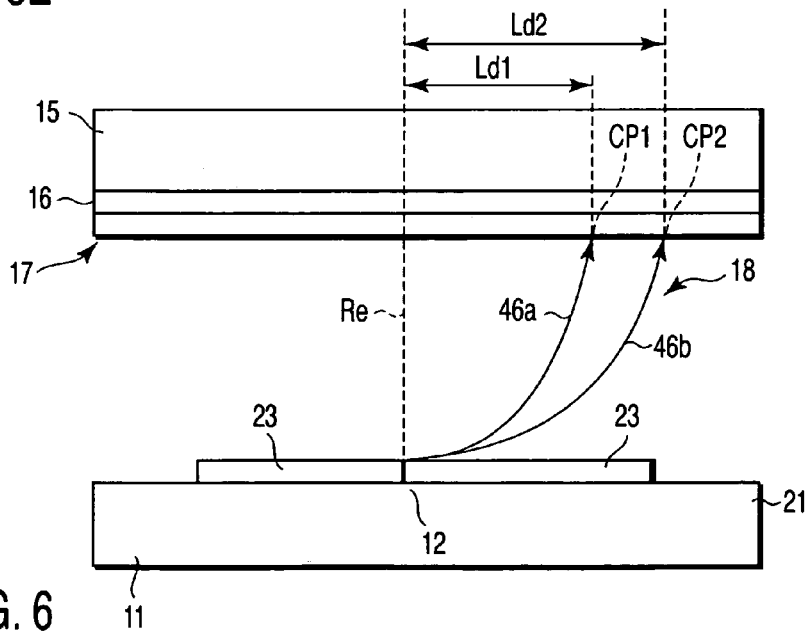
FIG. 6 is a view showing the loci of anode currents emitted from a flat electron source in the display apparatus having the phosphor layer shown in FIGS. 1 and 2.

In this operation in the first driving mode, an electron 18 emitted from an electron emitting portion 12 of an element film 23 is so displaced as to separate from a reference line Re and travels to the anode electrode 17. Consequently, as shown in FIG. 6, the electron forms a curved locus 46*a* having a certain directionality, and a deviation Ld1 based on the displacement occurs between the reference line Re and an intensity center Cp of a region on a faceplate 15 in FIG. 5C which is irradiated with the electron.

When the operation time intervals T1, T2, and T3 of the flat display apparatus are accumulated in this manner, and a cumulative time interval Ta of the time intervals T1 to T3 exceeds a reference time interval Ta1 determined under the first driving set condition (Ta >Ta1), preparations for driving mode switching is made. When the power switch of the display apparatus is turned off and turned on again in a state wherein this mode switching preparations are made, the driving mode is switched from the first driving mode to the second driving mode, as shown in FIG. 5B. That is, the first set condition (Va1, Vf1) is switched to the second set condition (Va2, Vf2) to drive the flat display apparatus in the second driving mode. In the second driving mode, as shown in FIGS. 5D and 5E, an anode voltage Va2 is applied to the anode electrode 17, and an element voltage Vf2 is applied to the element electrodes 13 and 14 of the electron source 22.

In the second driving mode, the electron 18 emitted from the electron emitting portion 12 of the element film 23 is so displaced as to separate from the reference line Re and travels to the anode electrode 17. Consequently, as shown in FIG. 6, the electron forms a curved locus 46*b* having a certain directionality, and a deviation Ld2 based on the displacement occurs between the reference line Re and the intensity center Cp of a region on the faceplate 15 which is irradiated with the electron, as shown in FIG. 5C. The intensity center Cp of the electron beam is more displaced in the second driving mode than in the first driving mode, and the deviation Ld2 becomes larger than the deviation Ld1 (Ld2 >Ld1). In this case, the degree to which the intensity center Cp of the electron is deviated and the deviations Ld2 and Ld1 depend on the anode voltages Va1 and Va2 and the element voltages Vf1 and Vf2.

If a cumulative time Tb of operation times in the second set condition exceeds a reference time interval Tb1 determined under the second set condition (Tb>Tb1), preparations for driving mode switching are made as in the above case. If the display apparatus is turned off and the power switch is turned on again during this switching preparation operation, the second set condition (Va2, Vf2) is switched to the first set condition (Va1, Vf1) again, and the flat display apparatus is operated in the first driving mode. Subsequently, as shown in FIG. 5B, the first and second set conditions are sequentially switched in the same manner as described above, and the first and second driving modes are alternately set. The flat display apparatus is operated in these set driving modes. In this case, the reference time interval Tb1 may be set to be shorter than the reference time interval Ta1, and the reference time interval Ta1 and a reference time interval Ta2 in the first driving mode may be set to be equal to each other. Alternatively, the reference time interval Ta1 may be set to be longer than the reference time interval Ta2.

As described above, the first and second driving modes are alternately switched, and the intensity center Cp of an electron shifts on the anode 17 upon this mode switching. Therefore, a point on the anode 17 on which a current is concentrated in the first driving mode differs from a point on the anode 17 on which a current is concentrated in the second driving mode. Since the points on the anode 17 on which currents are concentrated are alternately switched, a point where the anode current density is high is not fixed. This makes it possible to prevent an abrupt decrease in the luminous efficacy of a pixel corresponding to such a point and hence a decrease in the luminance of the pixel.

Figure 7:
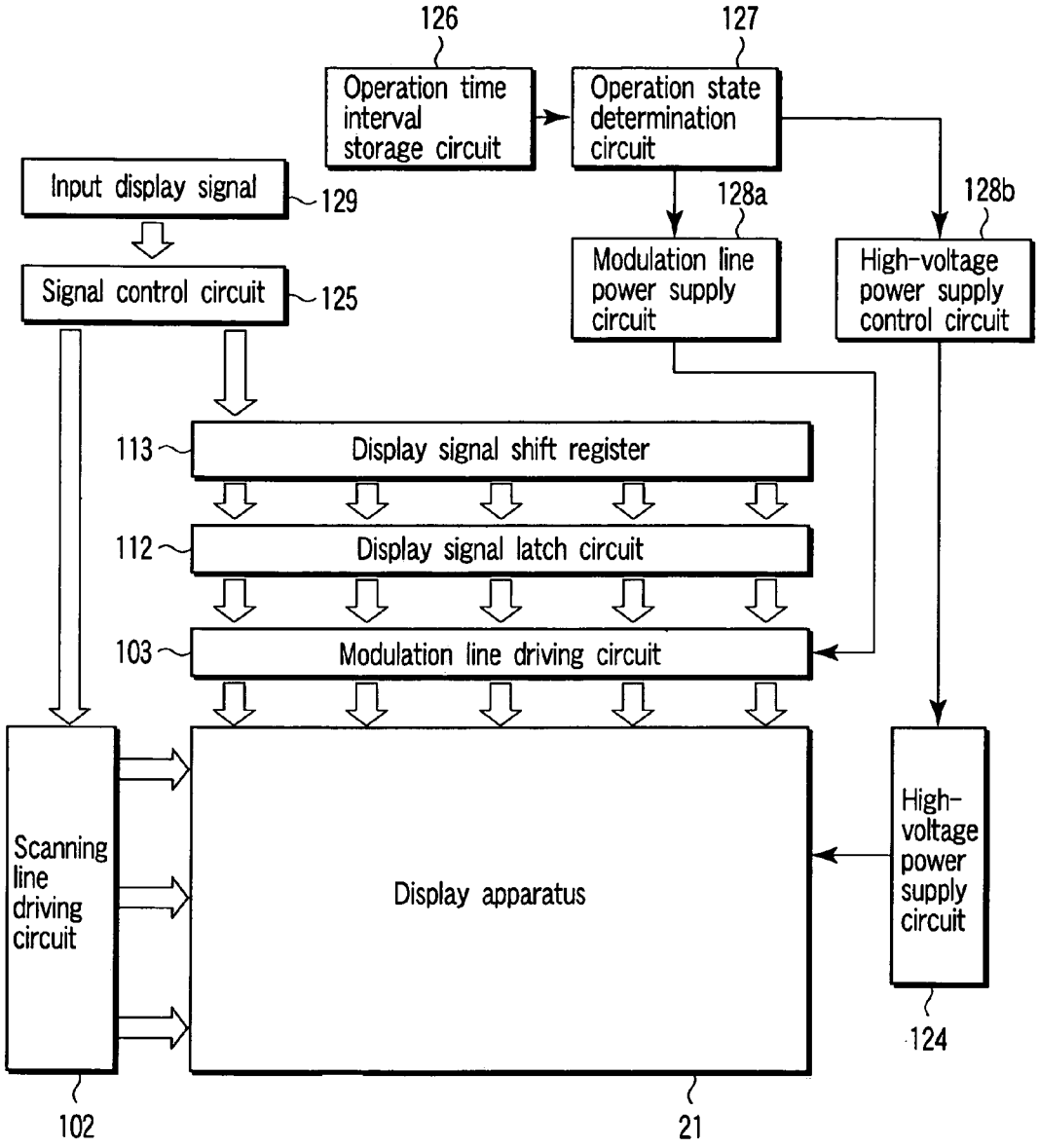
FIG. 7 is a block diagram showing a driving system for driving the display apparatus having the phosphor layer to which an embodiment of the method of driving the flat display apparatus according to the present invention is applied.

FIG. 7 is a block diagram showing a system for driving the display apparatus shown in FIG. 1.

As shown in FIG. 7, in order to apply drive pulse voltages to the respective electron sources 22 formed on the rear plate 21 of the display apparatus, a scanning line driving circuit 102 for generating scanning line selection signals and a modulation line driving circuit 103 for generating modulation line driving signals are connected to scanning lines 5-1, 5-2, 5-3, . . . and modulation lines 6-1, 6-2, 6-3, . . . . For example, in this flat display apparatus, 480 scanning lines 5-1, 5-2, 5-3, . . . are provided, and 640 modulation lines 6-1, 6-2, 6-3, . . . are provided for each of emission colors red (R), green (G), and blue (B). The scanning line driving circuit 102 sequentially outputs −9 V selection pulses to the scanning lines 5-1, 5-2, 5-3, . . . . The modulation line driving circuit 103 outputs 640×3=1,220 output signals as modulation line driving signals to the respective modulation lines 6-1, 6-2, 6-3, . . . . A high-voltage power supply circuit 124 for generating a high voltage is connected to the anode 17 of the faceplate.

A display signal 129 is input from outside the display apparatus to a signal control circuit 125. The signal control circuit 125 separates a sync signal and luminance signal from the input display signal 129, and generates a scanning line control signal and digital display signal from the sync signal and luminance signal. The signal control circuit 125 then supplies the scanning line control signal to the scanning line driving circuit 102, and the digital display signal to a display signal shift register 113. In the display signal shift register 113, the display signal which is digitized and sent time-serially is so shifted as to be supplied to a corresponding modulation line. A display signal latch circuit 112 is connected to the display signal shift register 113. The display signal latch circuit 112 latches the digital display signal from the display signal shift register 113. The display signal latch circuit 112 keeps holding the digital display signal from the display signal shift register 113 during one horizontal scanning period. After the lapse of one horizontal scanning period, the display signal latch circuit 112 latches a digital display signal for new horizontal scanning operation. The display signal latch circuit 112 is connected to the modulation line driving circuit 103. The modulation line driving circuit 103 converts the latched display signal into a pulse voltage signal having a pulse width corresponding to the luminance, and outputs the converted pulse voltage signal as a modulation line driving signal.

As described above, as the predetermined referent time intervals Ta1 and Ta2 elapse, the driving mode is changed, and the drive voltage Vf and anode voltage Va to be respectively applied to the electron source 22 and anode electrode 17 are changed. In order to change the drive voltage Vf and anode voltage Va, the system shown in FIG. 7 has an operation time interval storage circuit 126 and determination circuit 127 as control circuits. The operation time interval storage circuit 126 stores the operation time interval of the display apparatus. The determination circuit 127 determines the operation state of the apparatus on the basis of the stored operation time interval. The determination circuit 127 which determines an operation state includes a timer (not shown). The timer counts the time elapsed every time the display apparatus is operated. The operation time intervals are accumulated by the determination circuit 127, and the cumulative operation time interval is stored in the operation time interval storage circuit 126. In addition, the first and second voltage set conditions and reference time intervals corresponding to the first and second voltage set conditions are stored in the operation time interval storage circuit 126. The determination circuit 127 periodically accesses the determination circuit 127 to read out the currently effective first and second voltage set conditions and cumulative operation time intervals under the currently effective first and second voltage set conditions. When the currently effective first and second voltage set conditions exceed the predetermined reference time intervals, the determination circuit 127 sets the other conditions of the first and second voltage set conditions for the next display operation, and causes the operation time interval storage circuit 126 to store the other voltage set conditions as conditions effective for the next operation. Even when the display apparatus is turned off, the voltage set conditions for the next operation are kept held in the operation time interval storage circuit 126. When the display apparatus is tuned on after being turned off, the determination circuit 127 accesses the operation time interval storage circuit 126 to read out the voltage set conditions for the start of operation. The determination circuit 127 then changes the voltage set conditions. As a consequence, new set voltages are designated to a modulation line power supply circuit 128*a* which determines the voltage Vf of a pulse voltage to be applied to the electron source 22 and a high-voltage power supply control circuit 128*b* which sets an anode voltage. The flat display apparatus is then operated under new set conditions.

Figure 8A:
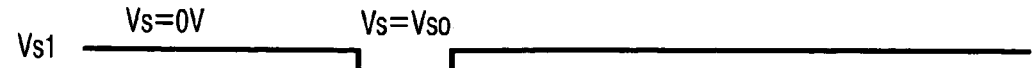
FIGS. 8A to 8F are timing charts showing scanning line selection signals to be applied to scanning lines in the driving system shown in FIG. 7 and modulation line driving signals to be supplied to modulation lines.
Figure 8B:
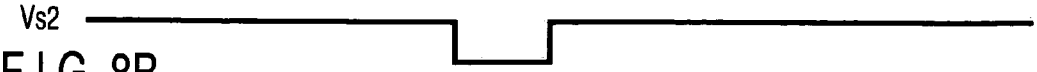
Figure 8C:
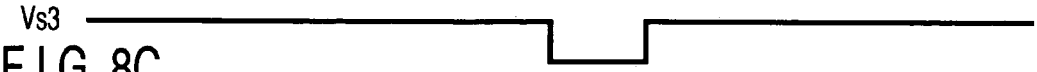
Figure 8D:
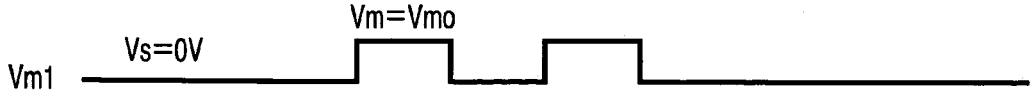
Figure 8E:
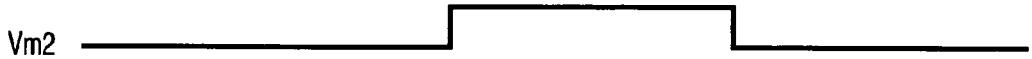
Figure 8F:
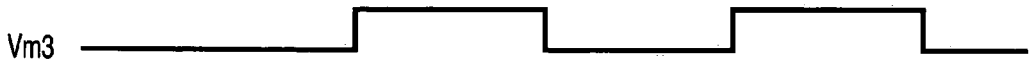

In the system shown in FIG. 7 which drives the display apparatus, an image is displayed on the display apparatus by applying pulse voltages to the respective electron sources 22 by a line sequential system. In the first driving mode, the anode voltage Va is maintained at the voltage Va1, and drive pulse voltages with a sequence like that shown in FIGS. 8A to 8C are applied to the scanning lines 5-1, 5-2, 5-3, . . . . In this case, when a selection pulse having a voltage Vso is applied to a given one of the scanning lines 5-1, 5-2, 5-3, . . . , all the electron sources 22 connected to the given scanning line are selected and set in the selected state. At this time, for example, a modulation line driving signal having a voltage level Vmo shown in FIGS. 8D to 8F is supplied to a given one of the modulation lines 6-1, 6-2, 6-3, . . . , and the drive voltage Vf having a level (Vf1 =−Vso +Vmo) is applied to the electron source 22 to be activated in accordance with the voltage level of this modulation line driving signal. If, for example, the voltage Vso is −9 V and the voltage Vmo is 6 V, the drive voltage Vf of 15 V is applied to the electron source 22. The anode electrode 17 is then irradiated with an electron from the electron source 22. As a consequence, an anode current required for display can be obtained. If the voltage Vso is 0 V, a voltage of 6 V or less is applied to the electron source 22, and the resultant anode current becomes almost 0. In addition, pulses are applied to the modulation lines 6-1, 6-2, 6-3, . . . with their widths being changed. The amount of electric charge injected into the anode electrode 17 can therefore be controlled to arbitrarily set a luminance for each pixel. Full-color display can be realized by modulating the pulse width in this manner.

In the second driving mode, the anode voltage Va is changed to the voltage Va2. Likewise, the drive voltage Vf is changed to the voltage Vf2. Drive pulse voltages having a sequence like that shown in FIGS. 8A to 8C are applied to the scanning lines 5-1, 5-2, 5-3, . . . . Modulation line driving signals having voltage levels changed in the same manner are supplied to the modulation lines 6-1, 6-2, 6-3, . . . . In accordance with the voltage level of this modulation line driving signal, the element voltage Vf2 having a level (Vf2=−Vso+Vmo) is applied to the electron source 22 to be activated. As in the above description, therefore, the amount of electric charge injected into the anode electrode 17 can be controlled to arbitrarily set a luminance for each pixel. Full-color display can be realized by modulating the pulse width in this manner.

In the embodiment of the driving method of the present invention, the conditions shown in Table 1 are set as the first and second set conditions.

TABLE 1

| | First and Second Operating Voltage Setting Conditions | | |
|---|---|---|---|
| Set Condition | Anode Voltage Va | Element Voltage Vf | Beam Position Ld |
| First | 10 kV | 15.0 V | 130 μm |
| Second | 8 kV | 15.6 V | 150 μm |

In the embodiment of the driving method of the present invention, two conditions are prepared for voltage set conditions. In first set condition 1, the anode voltage Va is set to 10 kV, and the element voltage Vf is set to 15.0 V. I second set condition 2, the anode voltage Va is set to 8 kV, and the element voltage Vf is set to 15.6 V.

In this case, as shown in FIG. 6, electron irradiation positions Cp1 and Cp2 on the faceplate 15 deviate from the reference line Re passing through the electron emitting portion 12 of each electron source 22 by distances Ld1 and Ld2, respectively. The deviation amounts Ld1 and Ld2 become 130 μm and 150 μm, respectively.

Figure 9A:
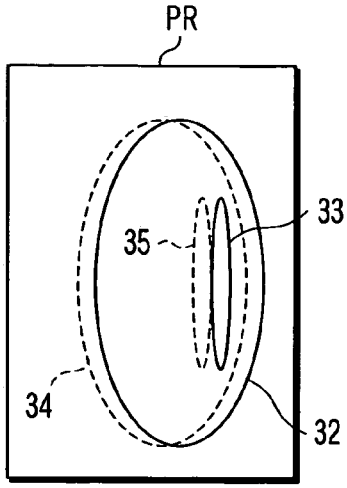
FIGS. 9A to 9C are plan views schematically showing temporal changes in emission pattern produced on the phosphor layer upon application of the method of driving the flat display apparatus according to the present invention.
Figure 9B:
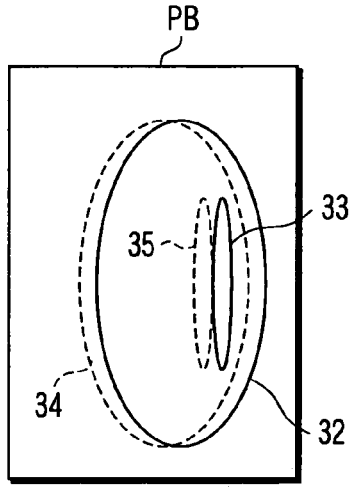
Figure 9C:
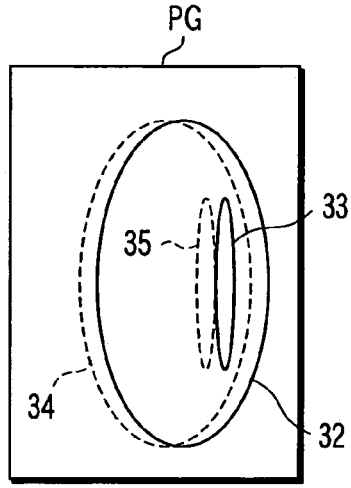

FIGS. 9A, 9B, and 9C are schematic enlarged views showing emission regions on the phosphor 16 when viewed from the front surface of the display panel. Referring to FIGS. 9A, 9B, and 9C, reference symbols PR, PB, and PG respectively denote red (R), green (G), and blue (B) phosphor regions. For example, the horizontal and vertical pitches of the phosphor regions PR, PB, and PG are respectively set to 300 μm and 900 μm. Each emission region corresponding to first voltage set condition 1 corresponds to a region 34 indicated by the broken line, and a region 35 in the region 34 in which the emission luminance is especially high is indicated by the broken line in the region 34. Each emission portion corresponding to second voltage set condition 2 corresponds to a region 32 indicated by the solid line, and a region 33 in the region 32 in which the emission luminance is especially high is indicated by the solid line in the region 32. The deviation amount Ld2 under second set condition 2 is larger than the deviation amount Ld1 under first set condition 1 by about 20 μm and greatly deviates from the reference line Re (Ld2>Ld1). In this embodiment, the difference between the deviations in the emission regions 34 and 35 is small. However, since the high-luminance portions CP1 and CP2 with high current densities are limited in very small regions, the concentration of currents injected into the phosphor layer can be sufficiently mitigated even with a deviation of 20 μm.

The cumulative operation time under each set condition is preferably proportional to the reciprocal of an anode current. In first set condition 1, an anode current Ia is about 3 μA. In second set condition 2, this current is about 5.6 μA. With such anode currents, the screen luminances under the two voltage set conditions become almost equal. This makes it possible to reduce changes in screen luminance due to switching of set conditions. The first and second cumulative driving times are preferably set to 200 Hr (Ta1) under set condition 1 and 100 Hr (Ta2) under set condition 2 so as to be almost proportional to the reciprocals of anode currents. Each operation time interval is set to be almost proportional to the reciprocal of an anode current so as to make a decrease in the luminous efficacy of the phosphor dependent on the amount of electric charge injected into the phosphor and to make the luminous efficacies under the two set conditions decrease at almost the same rate with the lapse of time. That is, the cumulative operation time under first set condition 1, in which the anode current is small, is preferably longer than that under second condition, in which the anode current is large, in accordance with the reciprocal of the current value.

Figure 10:
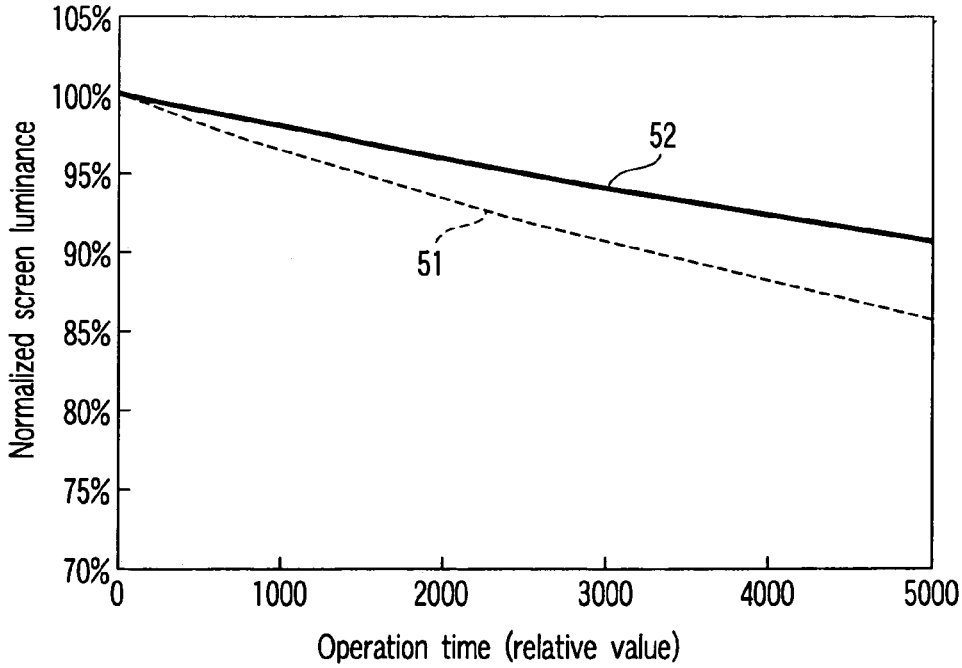
FIG. 10 is a graph showing the relationship between the operation time of the display apparatus having the phosphor layer shown in FIGS. 1 and 2 and the normalized screen luminance.

FIG. 10 shows the relationship between the operation time of the display apparatus and the normalized screen luminance. Referring to FIG. 10, a solid line 52 indicates changes in screen luminance over time in the display apparatus of the above embodiment. In this case, display on the display apparatus corresponds to display with the maximum luminance on the entire screen. The normalized screen luminance is obtained under this condition.

Each curve shown in FIG. 10 is obtained when the display apparatus is driven by a modulation line driving signal with a maximum pulse width of 30 μs. The power switch is turned on and off at intervals of an operation time of 10 Hr and a non-operation time of 10 min. For comparison, characteristics obtained when the display apparatus is continuously operated only under set condition 1 are indicated by a broken line 51. It has been confirmed that the driving method of this embodiment can make an improvement of about 60% in terms of time it takes to crease to a predetermined luminous efficacy as compared with the conventional driving method.

As described above, alternately driving the phosphor display panel using the flat electron sources under two kinds of voltage set conditions can mitigate the concentration of currents injected into high-luminance regions, in particular, and make an essential improvement in terms of a decrease in the luminous efficacy of the phosphor layer. In addition, set conditions 1 and 2 are switched in synchronism with the ON operation of the power switch of the display panel. This can prevent an observer from feeling odd when a displayed image changes as the luminance of the display screen changes during display operation.

SECOND EMBODIMENT

FIGS. 11A to 11D show a method of driving a display apparatus according to another embodiment of the present invention.

Figure 11A:
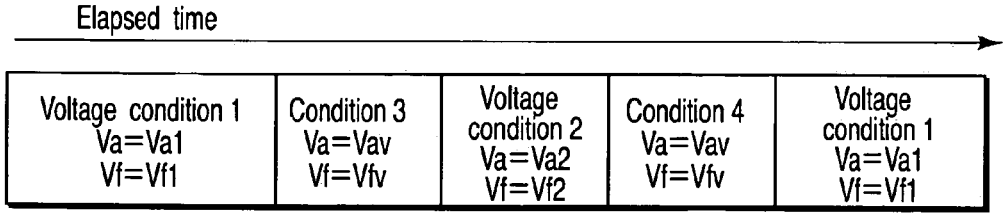
FIGS. 11A to 11D are views showing an operation sequence for driving the display apparatus having the phosphor layer shown in FIGS. 1 and 2 to which the method of driving the flat display apparatus according to another embodiment of the present invention is applied.
Figure 11B:
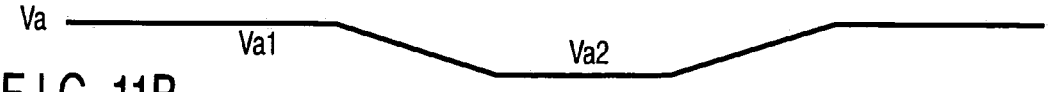
Figure 11C:
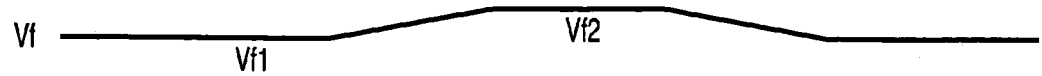
Figure 11D:
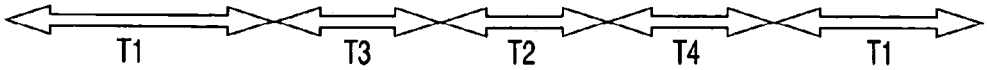

In the first embodiment, the voltage set set conditions are switched when the power switch of the display panel is turned on. In the second embodiment, one set condition is gradually shifted to the other set condition after the lapse of a predetermined operation time. More specifically, as shown in FIG. 11A, at first, the display apparatus is set in voltage condition 1 and driven in the first driving mode. As shown in FIG. 11D, during a given time interval T1, the display apparatus is maintained in voltage condition 1. In the time interval T1, as in the first embodiment, an anode voltage Va is applied to an anode 17, as shown in FIG. 11B, and an element voltage Vf1 is applied to an electron emitting element 23, as shown in FIG. 11C. When the time interval T1 elapses, voltage condition 1 is switched to voltage condition 2. In this case, voltage condition 1 is not rapidly switched to voltage condition 2 but is switched to voltage condition 2 through a shift time interval T3, as shown in FIG. 11D. In the shift time interval T3, an anode voltage Vav is gradually decreased from a voltage Va1 to a voltage Va2, and an element voltage Vfv is gradually decreased from the voltage Vf1 to a voltage F2. As shown in FIG. 6, therefore, the point on the anode 17 at which electrons concentrate moves from a position CP1 to a position CP2 on the anode 17. When the shift time interval T3 elapses, the display apparatus is maintained in voltage condition 2 and driven in the second driving mode. Likewise, when a time interval T2 during which the display apparatus is maintained in voltage condition 2 elapses, the voltage condition is restored to voltage condition 1 through a shift time interval T4. In the shift time interval T4, the anode voltage Vav is gradually increased from a voltage Va2 to a voltage al, and the element voltage Vfv is gradually decreased from a voltage Vf2 to a voltage f1. As shown in FIG. 6, therefore, the point on the anode 17 at which electrons concentrate is moved from the position CP2 to the position CP1 on the anode 17.

In the operation sequence shown in FIGS. 11A to 11D, for example, the voltages shown in Table 1 are used as the anode voltage values and element voltage values in set conditions 1 and 2. For example, the operation time intervals T1 and T2 are respectively set to two hours (2 Hr) and 1 hour (1 Hr), and the shift time intervals T3 and T4 are set to 1 hour (1 Hr).

Note that changes in the operation times T3 and T4, anode voltage Vav, and element voltage Vfv shown in FIG. 11 as well as changes in set conditions 1 and 2 and operation time intervals T1 and T2 described above are stored in an operation time interval storage circuit 126 shown in FIG. 7 as in the first embodiment, and stored conditions and the like are read out by an operation state determination circuit 137.

In the second embodiment, it is required to operate the panel with substantially the same emission luminance under voltage conditions 1 and 2 as in the first embodiment. That is, the anode voltage Va and element voltage Vf under the respective set conditions are set to obtain the substantially same emission luminance. When the power switch is turned off and then turned on again to operate the panel, the state during the switch-off period is stored in the operation time interval storage circuit 126 shown in FIG. 7. When the power switch is turned on, the set condition during the switch-off period is read out, and the display apparatus is restarted under the set condition. By the driving method according to the second embodiment as well, the situation in which the luminance of the display apparatus decreases can be improved.

The above embodiments use the set conditions shown in Table 1 but are not limited to those. Obviously, however, it is desirable that almost the same emission luminance be obtained under the respective set conditions. Conditions under which the display apparatus is driven with substantially the same luminance are important in the second embodiment, in particular, because the embodiment is based on the premise that display is continuous. Although the number of voltage set conditions are two, the present invention is not limited to this. The irradiation center positions of electron beams can be dispersed in accordance with the number of set conditions. This can make a further improvement in terms of a decrease in luminance.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of driving a display apparatus, the display apparatus including:

a first substrate having a first surface;

electron emitting elements, each configured to emit an electron beam, which are arranged on the first surface of the first substrate in a matrix form;

a second substrate having a second surface which faces the first surface with a gap therebetween;

an anode electrode formed at the second surface, and a phosphor layer formed on the anode electrode, and configured to emit light rays in response to irradiation of the electron beam;

said display method comprising:

selecting a first combination of a first anode voltage and a first element voltage;

applying the first anode voltage to the anode electrode during a first period and applying the first element voltage to the electron emitting elements selectively during the first period;

changing the first combination to a second combination of a second anode voltage and a second element voltage;

applying the second anode voltage to the anode electrode during a second period and applying the second element voltage to the electron emitting elements selectively during the second period;

changing the second combination to the first combination after the second period; and wherein the first and second periods are determined based on the first and second combinations respectively and are inverse proportional to an anode current flowing through the anode.

2. A method according to claim 1, wherein each of the electron emitting elements includes an element film and first and second electrodes opposing each other and disposed on the element film.

3. A method according to claim 1, wherein the display apparatus further includes:

a plurality of scanning lines arranged parallel to each other on the first surface of the first substrate;

a plurality of modulation lines which intersect the scanning lines so as to be electrically insulated therefrom and are arranged parallel to each other, the electron emitting elements being provided at intersections of the scanning lines and the modulation lines, and the first and second electrodes being respectively connected to the scanning line and the modulation line.

4. A method according to claim 3, wherein said display method further comprising:

generating a first scanning and modulating signal including the first element voltage, and generating a second scanning and modulating signal including the second element voltage:

supplying the first scanning and modulating signal to the scanning and modulation lines respectively, during the first period; and supplying the second scanning and modulating signal to the scanning and modulation lines respectively, during the second period.

5. A method according to claim 4, further comprising inputting a display signal to generate the first and second scanning and modulation signals, wherein the first and second combinations are so set as to provide a substantially same luminance display condition with respect to the same display signal.

6. A method according to claim 1, wherein changing the first combination includes switching a first power supply to a second power supply to generate the second combination.

7. A method according to claim 1, wherein changing the second combination includes switching a second power supply to a first power supply to generate the first combination.

8. A method according to claim 1, wherein changing the first combination includes gradually changing the first anode voltage to the second anode voltage, and the first element voltage to the second voltage, and changing the second combination includes gradually changing the second anode voltage to the first anode voltage, and the second element voltage to the first voltage.

9. A method according to claim 1, wherein changing the first combination includes applying an intermediate anode voltage between the first and second anode voltages to the anode and applying an intermediate element voltage between the first and second element voltages to the electron emitting element during an third period after the first period, and changing the second combination includes applying the intermediate anode voltage between the first and second anode voltages to the anode and applying the intermediate element voltage between the first and second element voltages to the electron emitting element during the fourth period after the second period.

10. A method according to claim 1, wherein the first and second combinations cause the electron beams to be landed on first and second positions on the phosphor layer, respectively.

11. A system for driving a display apparatus, comprising:

a first substrate having a first surface;

electron emitting elements, each configured to emit an electron beam, which are arranged on the first surface of the first substrate in a matrix form;

a second substrate having a second surface which faces the first surface with a gap therebetween;

an anode electrode formed at the second surface, and a phosphor layer formed on the anode electrode and configured to emit light rays in response to irradiation of the electron beam;

a selecting portion configured to select a first combination of a first anode voltage and a first element voltage to apply the first anode voltage to the anode electrode and apply the first element voltage to the electron emitting elements selectively, during a first period;

a changing portion configured to change the first combination to a second combination of a second anode voltage and a second element voltage after the first period to apply the second anode voltage to the anode electrode and apply the second element voltage to the electron emitting elements selectively, during a second period, and change the second combination to the first combination after the second period; and wherein the first and second periods are determined based on the first and second combinations respectively and are inverse proportional to an anode current flowing through the anode.

12. A system according to claim 11, wherein each of the electron emitting elements includes an element film and first and second electrodes opposing each other and disposed on the element film.

13. A system according to claim 11, wherein the display apparatus further includes:

a plurality of scanning lines arranged parallel to each other on the first surface of the first substrate;

a plurality of modulation lines which intersect the scanning lines so as to be electrically insulated therefrom and are arranged parallel to each other, the electron emitting elements being provided at intersections of the scanning lines and the modulation lines, and the first and second electrodes being respectively connected to the scanning line and the modulation line.

14. A system according to claim 11, wherein the selecting portion includes:

a signal generator configured to generate a first scanning and modulating signal including the first element voltage, supply the first scanning and modulating signal to the scanning and modulation lines respectively, during a first period, generate a second scanning and modulating signal including the second element voltage and supply the second scanning and modulating signal to the scanning and modulation lines respectively, during a second period.

15. A system according to claim 14, further comprising an input portion configured to input a display signal to generate the scanning and modulation signal, wherein the first and second combinations are so set as to provide a substantially same luminance display condition with respect to the same display signal.

16. A System according to claim 11, further comprising a switching portion configured to switch a first power supply to a second power supply to generate the first combination.

17. A System according to claim 11, further comprising a switching portion configured to switch a second power supply to a first power supply to generate the first combinations.

18. A system according to claim 11, wherein the changing portion gradually changes the first anode voltage to the second anode voltage and the first element voltage to the second voltage, and gradually changes the second anode voltage to the first anode voltage, and the second element voltage to the first voltage.

19. A system according to claim 11, wherein the changing portion includes an applying portion configured to apply an intermediate anode voltage between the first and second anode voltages to the anode and to apply an intermediate element voltage between the first and second element voltages to the electron emitting element during a third period after the first period and during a fourth period after the second period, respectively.

20. A system according to claim 11, wherein the first and second combinations cause the electron beams to be landed on first and second positions on the phosphor layer, respectively.

21. A method of driving a display apparatus, the display apparatus including:

a first substrate having a first surface;

electron emitting elements, each configured to emit an electron beam, which are arranged on the first surface of the first substrate in a matrix form;

a second substrate having a second surface which faces the first surface with a gap therebetween;

an anode electrode formed at the second surface, and a phosphor layer formed on the anode electrode, and configured to emit light rays in response to irradiation of the electron beam;

said display method comprising:

selecting a first combination of a first anode voltage and a first element voltage;

applying the first anode voltage to the anode electrode during a first period and applying the first element voltage to the electron emitting elements selectively during the first period;

changing the first combination to a second combination of a second anode voltage and a second element voltage;

applying the second anode voltage to the anode electrode during a second period and applying the second element voltage to the electron emitting elements selectively during the second period;

changing the second combination to the first combination after the second period; and wherein changing the first combination includes gradually changing the first anode voltage to the second anode voltage, and the first element voltage to the second voltage, and changing the second combination includes gradually changing the second anode voltage to the first anode voltage, and the second element voltage to the first voltage.

22. A method according to claim 21, wherein each of the electron emitting elements includes an element film and first and second electrodes opposing each other and disposed on the element film.

23. A method according to claim 21, wherein the display apparatus further includes:

a plurality of scanning lines arranged parallel to each other on the first surface of the first substrate;

a plurality of modulation lines which intersect the scanning lines so as to be electrically insulated therefrom and are arranged parallel to each other, the electron emitting elements being provided at intersections of the scanning lines and the modulation lines, and the first and second electrodes being respectively connected to the scanning line and the modulation line.

24. A method according to claim 21, wherein said display method further comprising:

generating a first scanning and modulating signal including the first element voltage, and generating a second scanning and modulating signal including the second element voltage:

supplying the first scanning and modulating signal to the scanning and modulation lines respectively, during the first period; and supplying the second scanning and modulating signal to the scanning and modulation lines respectively, during the second period.

25. A method according to claim 24, further comprising inputting a display signal to generate the first and second scanning and modulation signals, wherein the first and second combinations are so set as to provide a substantially same luminance display condition with respect to the same display signal.

26. A method according to claim 21, wherein changing the first combination includes switching a first power supply to a second power supply to generate the second combination.

27. A method according to claim 21, wherein changing the second combination includes switching a second power supply to a first power supply to generate the first combination.

28. A method according to claim 21, wherein changing the first combination includes applying an intermediate anode voltage between the first and second anode voltages to the anode and applying an intermediate element voltage between the first and second element voltages to the electron emitting element during an third period after the first period, and changing the second combination includes applying the intermediate anode voltage between the first and second anode voltages to the anode and applying the intermediate element voltage between the first and second element voltages to the electron emitting element during the fourth period after the second period.

29. A method according to claim 21, wherein the first and second combinations cause the electron beams to be landed on first and second positions on the phosphor layer, respectively.

30. A system for driving a display apparatus, comprising:

a first substrate having a first surface;

electron emitting elements, each configured to emit an electron beam, which are arranged on the first surface of the first substrate in a matrix form;

a second substrate having a second surface which faces the first surface with a gap therebetween;

an anode electrode formed at the second surface, and a phosphor layer formed on the anode electrode and configured to emit light rays in response to irradiation of the electron beam;

a selecting portion configured to select a first combination of a first anode voltage and a first element voltage to apply the first anode voltage to the anode electrode and apply the first element voltage to the electron emitting elements selectively, during a first period; and a changing portion configured to change the first combination to a second combination of a second anode voltage and a second element voltage after the first period to apply the second anode voltage to the anode electrode and apply the second element voltage to the electron emitting elements selectively, during a second period, and change the second combination to the first combination after the second period, wherein the changing portion gradually changes the first anode voltage to the second anode voltage and the first element voltage to the second voltage, and gradually changes the second anode voltage to the first anode voltage, and the second element voltage to the first voltage.

31. A system according to claim 30, wherein each of the electron emitting elements includes an element film and first and second electrodes opposing each other and disposed on the element film.

32. A system according to claim 30, wherein the display apparatus further includes:

a plurality of scanning lines arranged parallel to each other on the first surface of the first substrate;

a plurality of modulation lines which intersect the scanning lines so as to be electrically insulated therefrom and are arranged parallel to each other, the electron emitting elements being provided at intersections of the scanning lines and the modulation lines, and the first and second electrodes being respectively connected to the scanning line and the modulation line.

33. A system according to claim 30, wherein the selecting portion includes:

a signal generator configured to generate a first scanning and modulating signal including the first element voltage, supply the first scanning and modulating signal to the scanning and modulation lines respectively, during a first period, generate a second scanning and modulating signal including the second element voltage and supply the second scanning and modulating signal to the scanning and modulation lines respectively, during a second period.

34. A system according to claim 30, further comprising an input portion configured to input a display signal to generate the scanning and modulation signal, wherein the first and second combinations are so set as to provide a substantially same luminance display condition with respect to the same display signal.

35. A system according to claim 30, further comprising a switching portion configured to switch a first power supply to a second power supply to generate the first combination.

36. A system according to claim 30, further comprising a switching portion configured to switch a second power supply to a first power supply to generate the first combinations.

37. A system according to claim 30, wherein the changing portion includes an applying portion configured to apply an intermediate anode voltage between the first and second anode voltages to the anode and to apply an intermediate element voltage between the first and second element voltages to the electron emitting element during a third period after the first period and during a fourth period after the second period, respectively.

38. A system according to claim 30, wherein the first and second combinations cause the electron beams to be landed on first and second positions on the phosphor layer, respectively.

* * * * *